US006156981A

United States Patent [19]

Ward et al.

[11] Patent Number: 6,156,981

[45] Date of Patent: Dec. 5, 2000

[54] SWITCH FOR DATA CONNECTOR JACK

[75] Inventors: Terrence S. Ward; Bernie Hammond, both of Cordova, Tenn.

[73] Assignee: Thomas & Betts International, Inc., Sparks, Nev.

[21] Appl. No.: 09/443,664

[22] Filed: Nov. 19, 1999

Related U.S. Application Data

[60] Provisional application No. 60/147,689, Aug. 6, 1999.

[51] Int. Cl.[7] ..... H01R 29/00

[52] U.S. Cl. ..... 200/16 D; 439/188

[58] Field of Search ..... 439/188, 489, 439/440; 200/531, 532, 51.07, 16 D, 51.05, 51.06

[56] References Cited

U.S. PATENT DOCUMENTS

| | | | |
|---|---|---|---|
| 2,072,729 | 3/1937 | Corbett | 200/114 |
| 2,186,813 | 1/1940 | Adam et al. | 200/114 |
| 2,617,847 | 11/1952 | Cole | 173/328 |
| 2,907,849 | 10/1959 | Kobryner | 200/119 |
| 3,020,373 | 2/1962 | Kobryner et al. | 200/133 |
| 3,284,598 | 11/1966 | George et al. | 200/133 |
| 3,379,842 | 4/1968 | Downs et al. | 200/114 |
| 3,418,615 | 12/1968 | Canney | 337/190 |
| 3,732,516 | 5/1973 | Puetz | 337/194 |
| 4,183,003 | 1/1980 | Cleveland et al. | 337/156 |
| 4,488,767 | 12/1984 | Lehman et al. | 339/91 |

*Primary Examiner*—Gary F. Paumen
*Assistant Examiner*—Ross Gushi
*Attorney, Agent, or Firm*—G. Andrew Barger

[57] ABSTRACT

A switch for a data connector jack adaptable to receive a plug operating in a high frequency range or a plug operating in a low frequency range therein. The data connector jack is coupled to a cable having a plurality of wires contained therein. The switch has a primary state, an intermediate state, and a secondary state, and includes a printed circuit board having a surface. A plurality of row contacts are mounted on the surface of the printed circuit board and a plurality of bifurcated contacts are spaced apart from the plurality of row contacts and mounted on the surface the printed circuit board. A grounding pad is mounted on the surface of the printed circuit board and a jumper assembly. The jumper assembly includes an insulator pad and a plurality of jumper springs flexibly connected to the insulator pad and in abutting contact with the surface of the printed circuit board such that at least one of the plurality of jumper springs is in abutting communication with the grounding pad when the plurality of jumper springs are in the open position, the transition position, and the closed position to prevent crosstalk among the plurality of jumper springs.

25 Claims, 7 Drawing Sheets

SWITCH FOR DATA CONNECTOR JACK

RELATED REFERENCES

Priority is claimed herein to co-pending provisional patent application titled WIPING SWITCH FOR A HIGH SPEED DATA CONNECTOR, filed Aug. 6, 1999, and having application Ser. No. 60/147,689.

FIELD OF THE INVENTION

In general, the present invention relates to data connectors and, in particular, the present invention relates to a switch for a data connector jack for automatically receiving multiple plugs operating in a high frequency range or a low frequency range therein.

BACKGROUND

The connector industry has been striving to develop data connectors that meet increasingly higher standards for data transfer rates while maintaining or reducing crosstalk between the contacts of the connector. Simultaneously, the industry has sought to allow existing connector plugs, which are already coupled to data components such as computers in the marketplace, to be able to couple to jacks of the improved connectors so that the entire marketplace will not have to upgrade the existing connector plugs if the improved performance is not needed.

In accordance with these demands, the industry has created a new RJ-45 type connector having a jack to which Category 5–7 connector plugs, which meet the ANSI/TIA/EIA-568-A to 768-A specifications, can operationally couple. This new RJ45 type jack has resulted in a complex design including a number of circuit boards and components. Also, the RJ-45 type jack leaves a physical gap between switching contacts such that dust and debris can collect thereon causing decreased electrical connectivity performance. Moreover, contacts that are not being used in the jack are open circuited thus increasing crosstalk. Further lacking is an intermediate stage where all contacts are open circuited when the jack is switched from a Category 6 or less connector to a Category 7 or greater thereby eliminating crosstalk between "live" contacts and open circuited contacts, which could act as an antenna for the RF signals emanating from the live contacts.

SUMMARY OF THE INVENTION

A switch is provided in the present invention for a data connector jack that is adaptable to receive a plug operating in a high frequency range or a plug operating in a low frequency range therein. The data connector jack is coupled to a cable that has a plurality of wires contained therein. The switch has a primary state, an intermediate state, and a secondary state, and includes a printed circuit board having a surface. A plurality of row contacts are mounted on the surface of the printed circuit board and a plurality of bifurcated contacts are spaced apart from the plurality of row contacts and mounted on the surface the printed circuit board. A grounding pad is mounted on the surface of the printed circuit board and a jumper assembly. The jumper assembly includes an insulator pad and a plurality of jumper springs flexibly connected to the insulator pad and in abutting contact with the surface of the printed circuit board such that at least one of the plurality of jumper springs is in abutting communication with the grounding pad when the plurality of jumper springs are in the open position, the transition position, and the closed position to prevent crosstalk among the plurality of jumper springs.

When the switch is in the primary state the plurality of row contacts are electrically active for communicating with the plug operating in the high frequency range via the plurality of jumper springs being in the open position. In addition, when the switch is in the intermediate state at least one of the plurality of row contacts are electrically active and none of the plurality of bifurcated contacts are electrically active via the plurality of jumper springs being in the transition position. When the switch is in the secondary state the plurality of row contacts are electrically active for communicating with the plug operating in the low frequency range via the plurality of jumper springs being in the closed position.

A grounding pad is mounted on the surface of the printed circuit board such that at least one of the plurality of jumper springs is in abutting communication with the grounding pad when the plurality of jumper springs are in the open position, the transition position, and the closed position to prevent crosstalk among the plurality of jumper springs. Further, a plurality of contact pads are each coupled through the printed circuit board to one of the plurality of row contacts. When the plurality of jumper springs transition from the open state to the closed state, the plurality of jumper springs are in slidingly abutting communication with the plurality of contact pads such that debris is cleared from the plurality of contact pads.

In one embodiment of the invention the grounding pad individually surrounds each of the plurality of contact pads on the surface of the printed circuit board such that RF signals from any one of the plurality of contact pads is electrically grounded and is thereby prevented from interfering with another of the plurality of contact pads.

Moreover, the grounding pad individually surrounds each of the plurality of bifurcated contacts on the surface of the printed circuit board such that RF signals from any one of the plurality of bifurcated contacts is electrically grounded and is thereby prevented from interfering with another of the plurality of bifurcated contacts. In addition, the grounding pad individually surrounds each of the plurality of row contacts on the surface of the printed circuit board such that RF signals from any one of the plurality of row contacts is electrically grounded and is thereby prevented from interfering with another of the plurality of row contacts.

DETAILED DESCRIPTION OF THE PREFERRED EMBODIMENT(S)

Figure 1:
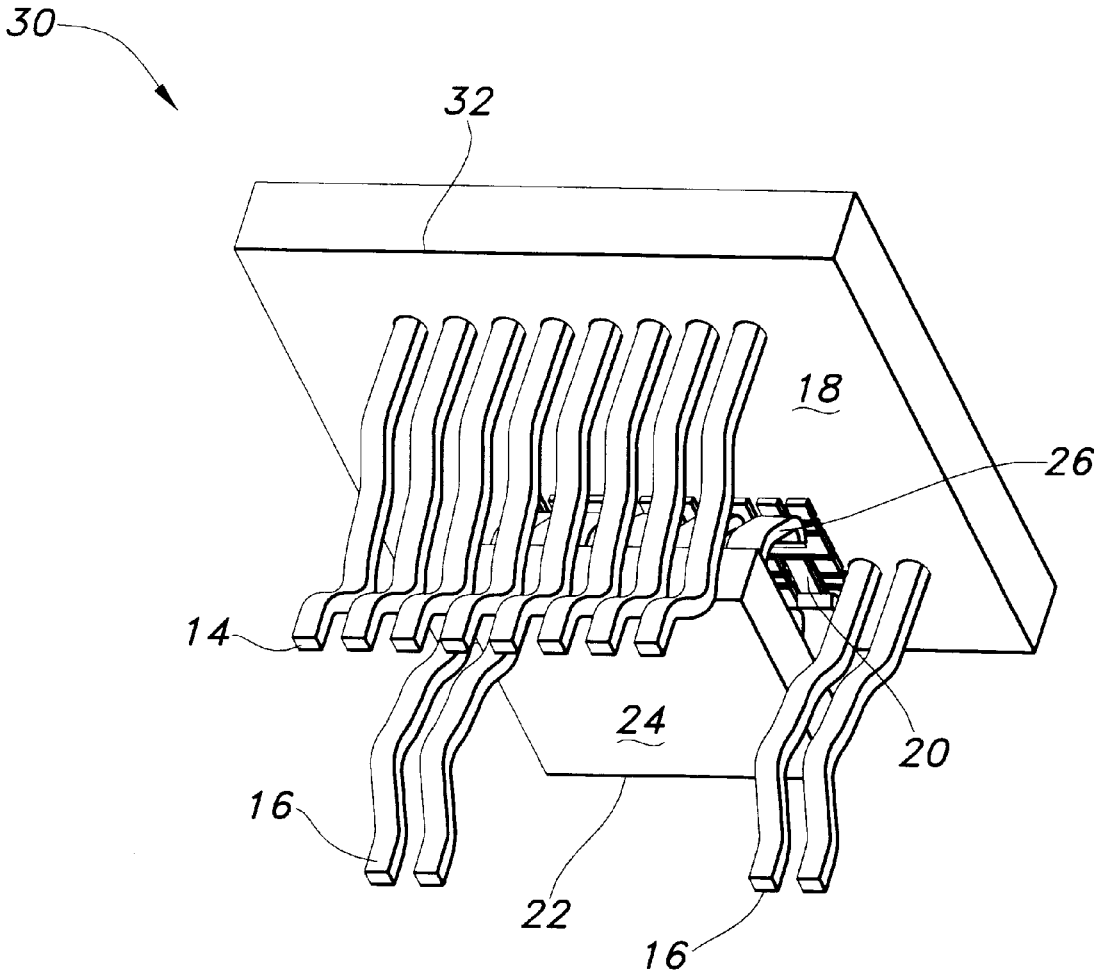
FIG. 1 is a perspective view of a printed circuit board (PCB) of the present invention being contacted by a jumper assembly also of the present invention having a plurality of jumper springs disposed therein.

The above and other features, aspects, and advantages of the present invention will now be discussed in the following detailed description and appended claims, which are to be considered in conjunction with the accompanying drawings in which identical reference characters designate like elements throughout the views. Shown in FIG. 1 is a switch 30 for a high frequency data connector that preferably operates in a frequency range on the order of 600 MHZ or higher, which fully meets Category 7 requirements as prescribed by IEC 60603-7 for operation, reliability, and small form factoring. It is understood that the switch 30 is mounted in the jack of the data connector and is highly adaptable, as will be discussed in greater detail below, such that data connector plugs with lower operational frequencies like Category 5 or 6 will be fully operational when coupled to the jack of the present connector.

Figure 3:
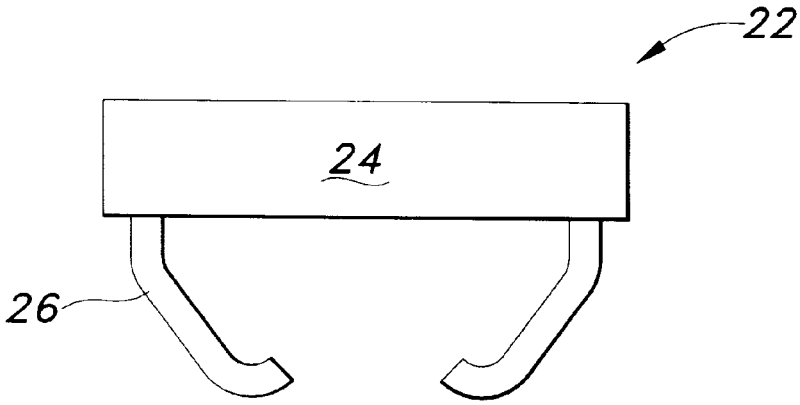
FIG. 3 is a side elevational view of the jumper assembly of the present invention.
Figure 4:
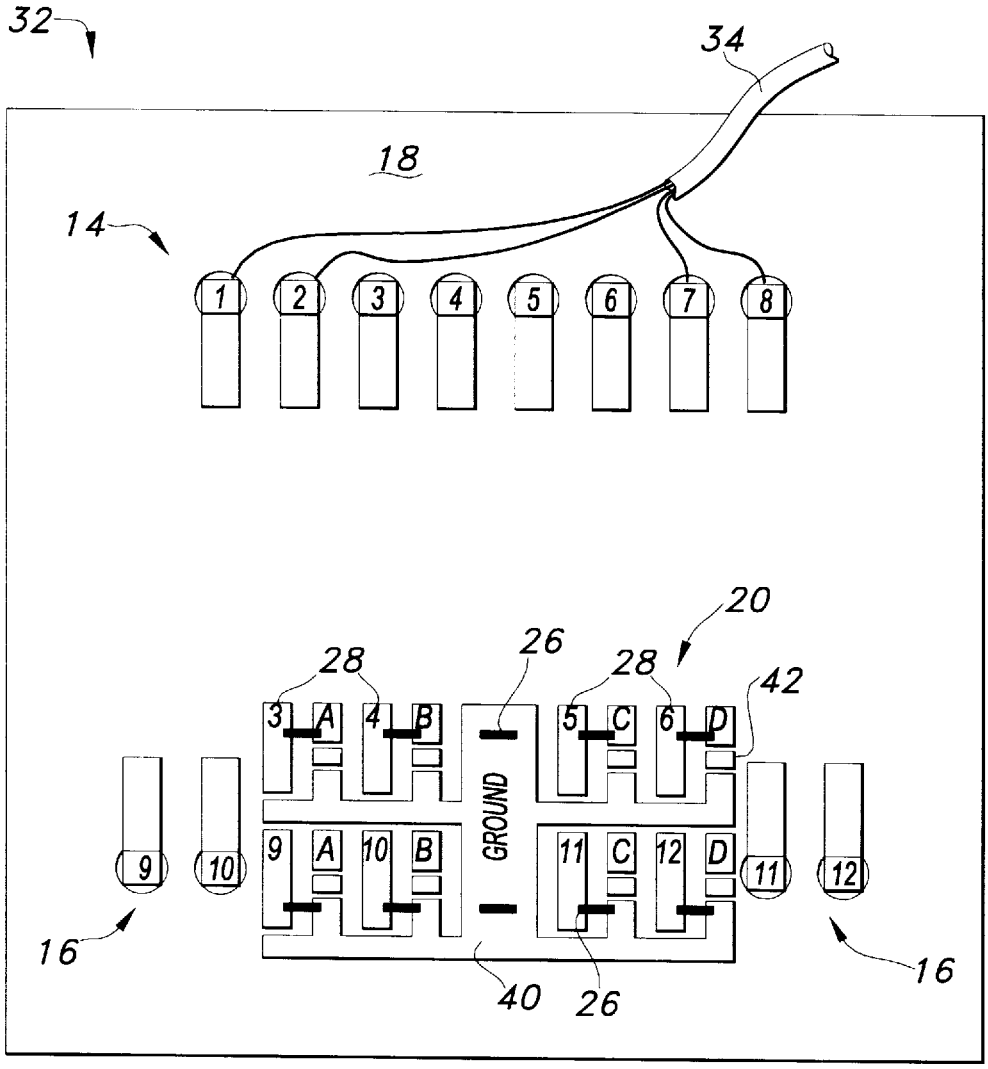
FIG. 4 is a plan view of the PCB of the present invention with the jumper springs in a primary state.

A printed circuit board 32 ("PCB") including a surface 18, as shown in FIGS. 4–7, is mounted in the jack of the present connector and includes a set of row contacts 14 and a spaced apart set of bifurcated contacts 16 soldered to apertures 36 mounted in the surface 18 of the PCB 32. There are eight contacts on the set of row contacts 14, but at most only four of the contacts are each operational with a wire of a twisted pair cable 34, as shown in FIG. 4. The four end row contacts 14 displaying numerals 1–2 and 7–8, are each "hard wired" to a wire of a twisted pair cable 34. It is the row contacts 14 displaying numerals 3–6 and bifurcated contacts 16 displaying numerals 9–12 that switched between an active state and ground in the present invention by the switch 30 depending upon the type of plug installed in the jack. The row contacts 14 and bifurcated contacts 16 extend partially through the PCB 32, which as described above has a circuit surface 18 on which a contact grid 20 is inlayed as shown in FIGS. 1–5 and 8.

Figure 2:
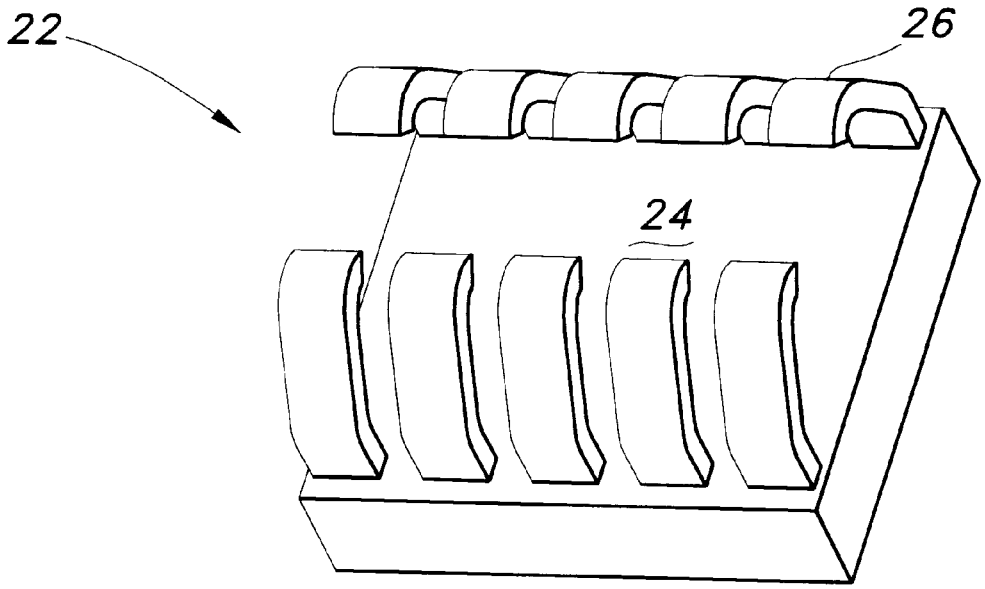
FIG. 2 is a perspective view of the jumper assembly of the present invention.
Figure 5:
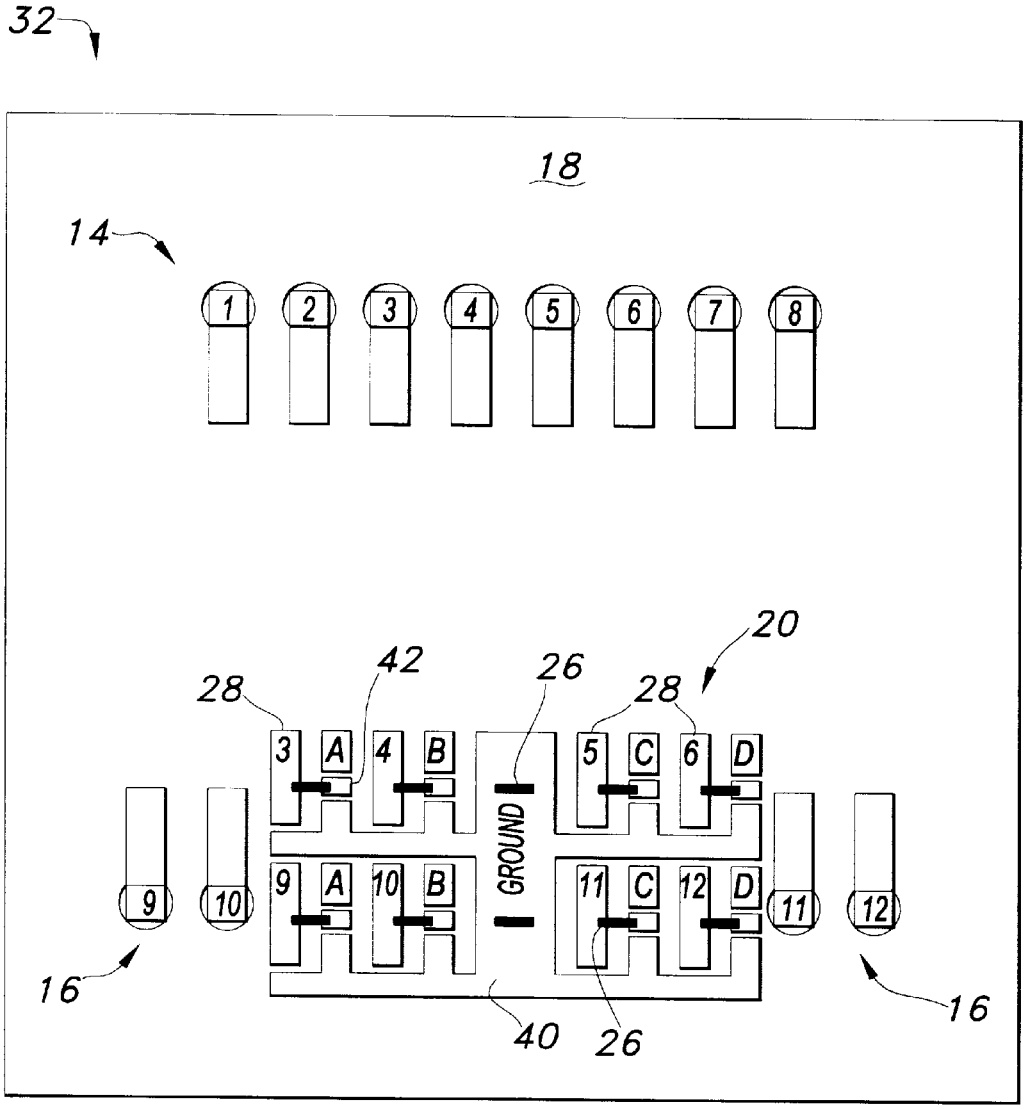
FIG. 5 is a plan view of the PCB of the present invention with the jumper springs in an intermediate state.
Figure 6:
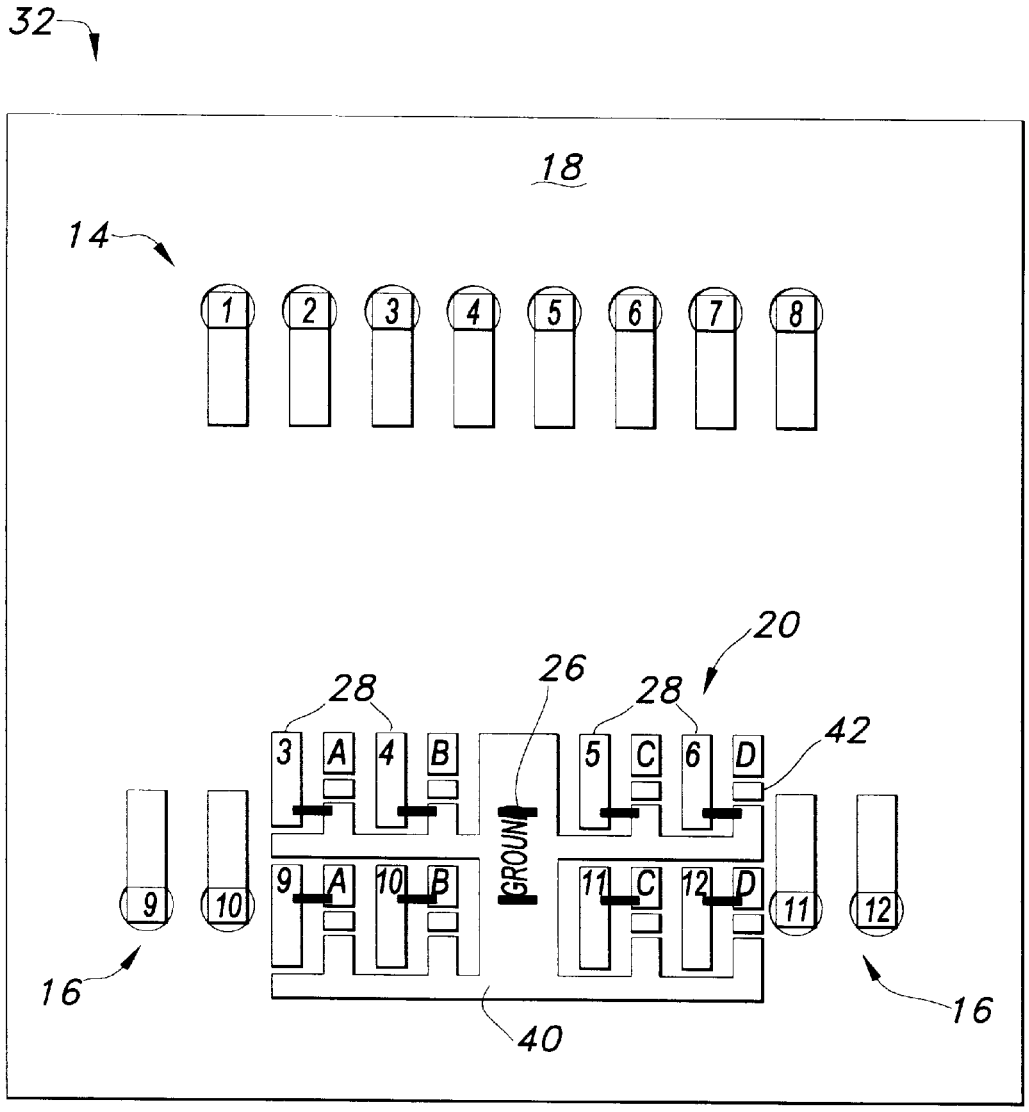
FIG. 6 is a plan view of the PCB of the present invention with the jumpers in a secondary state.
Figure 8:
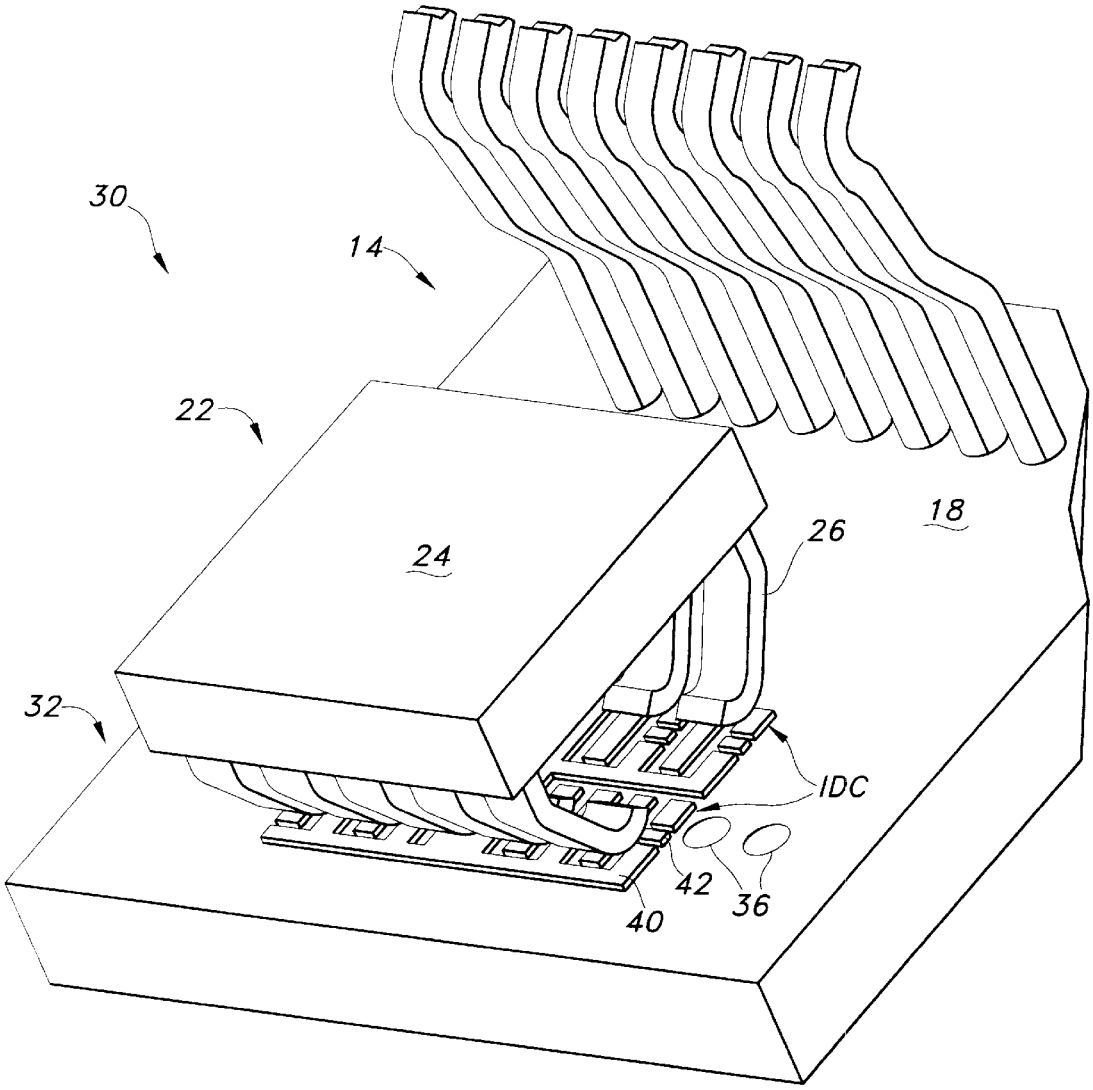
FIG. 8 is a perspective view of the insulator member and PCB of the present invention.

Referring with particularity to FIGS. 2 and 3, a jumper assembly 22 is shown having an insulator pad 24 preferably constructed of PBT that serves as an insulative material for electrical conductivity. Secured in the insulator pad 24 are a plurality of jumper springs 26 that deflect inwardly toward the middle of the insulator pad 24 when compressed, which is shown in FIGS. 3 and 8. Moreover, the plurality of jumper springs 26 that are flexibly secured to the insulator pad 24 have three primary positions. The first is the open position as shown in FIG. 4, the second is the transition position as shown in FIG. 5, and the third is the closed position that is shown in FIG. 6. Each of these positions for the jumper springs 26 will be discussed in greater detail below.

At least one of the plurality of jumper springs 26 is in abutting communication with the grounding pad 40 when the plurality of jumper springs 26 are in the open position, the transition position, and the closed position to prevent crosstalk among the plurality of jumper springs 26. Preferably, the two center jumper springs 26 are always in abutting contact with the ground pad 40, as shown in FIGS. 4–7, thereby further isolating the bifurcated contacts 16 disposed on either side of the contact grid 20 of the PCB 32. This further isolation servers to pull RF signals emanating from the bifurcated contacts 16 to ground thereby further limiting crosstalk between the bifurcated contacts 16 in addition to the physical separation.

Shown in FIG. 4 is the contact grid 20 with the jumper springs 26 in the open position such that the jumper springs 26 are not compressed and in abutting contact against the contact grid 20. It is understood that the row contacts 14 are connected to their corresponding numbered pad on the contact grid 20 via inlayed connection through the PCB 32. The jumper springs 26 are shown connecting circuit A of the PCB 32 to contact pad 3, circuit B to contact pad 4, circuit C to contact pad 5 and circuit D to contact pad 6, while the bifurcated contacts 16 displaying numerals 9–12 are grounded to grounding pad 40. In this primary state, all of the row contacts 14 displaying numerals 1–8 are in an active state of operation for a Category 7 plug to be installed in the jack.

Shown in FIG. 5 is the contact grid 20 with the jumper springs 26 in the transition position such that the jumper springs 26 are compressed or forced together approximately halfway while abutting the contact grid 20. It is understood that the row contacts 14 are connected to their corresponding numbered pad on the contact grid 20 via inlayed connection through the PCB 32. It is an important feature of the present invention that the jumper springs 26 when compressed and moved together never leave the surface of the contact grid 20 such that a wiping function is performed on the contact grid 20 thereby clearing debris from the grid surface and yielding a more stable and conductive electrical conductivity. In this transition position the jumper springs 26 are shown connecting contact pads 3–6 to individual intermediate pads 42, which are neither grounded nor active such that there is a complete break between the active and grounded states of row contacts 14 displaying numerals 3–6 during a transition from a high frequency plug to a lower frequency such as from a Category 7 plug to a Category 5 or 6. Simultaneously, the bifurcated contacts 16 displaying numerals 9–12 are also coupled to the intermediate pads 42 while being transitioned from a grounded state to an active state. In this intermediate state only row contacts 14 displaying numerals 1–2 and 7–8 are active.

Shown in FIG. 6 is the contact grid 20 with the jumper assembly 22 in a closed position such that the jumper springs 26 are fully compressed and abutting against the contact grid 20. When the plurality of jumper springs 26 transition from the open state to the closed state the plurality of jumper springs 26 are in slidingly abutting communication with the plurality of contact pads 3–6 and 9–12 such that debris is cleared from the plurality of contact pads 3–6 and 9–12. It is understood that the row contacts 14 are connected to their corresponding numbered contact pad on the contact grid 20 via inlayed connection through the PCB 32. The jumper springs 26 are shown connecting circuit A of the PCB 32 to contact pad 9, circuit B to contact pad 10, circuit C to contact pad 11 and circuit D to contact pad 12, while the row contacts 14 displaying numerals 320 6 are grounded to grounding pad 40. In this closed position or secondary state, the four quadrants of the jack are active meaning that the row contacts 14 displaying numerals 1–2 and 7–8, and the bifurcated contacts 16 displaying numerals 9–10 and 11–12 are in an active state of operation for a Category 5 plug to be installed in the jack. Plugs of this nature include a projection that abuts against the insulator pad 24 of the jumper assembly 22 thereby compressing the jumper springs 26 together and causing the wiping action to take place on the contact grid 20 as the connector changes from the open position to the transition position and then finally to the closed position.

The switch 30 of the present invention has a primary state as shown in FIG. 4, an intermediate state as shown in FIG. 5, and a secondary state as shown in FIG. 6. When the switch 30 is in the primary state the plurality of row contacts 14 are electrically active for communicating with the plug operating in the high frequency range via the plurality of jumper springs 26 being in the open position. Moreover, when the switch 30 is in the intermediate state at least one of the plurality of row contacts 14 are electrically active and none of the plurality of bifurcated contacts 16 are electrically active via the plurality of jumper springs 26 being in the transition position. If, however the switch 30 is in the secondary state the plurality of row contacts 14 are electrically active for communicating with the plug operating in the low frequency range via the plurality of jumper springs 26 being in the closed position.

Figure 7:
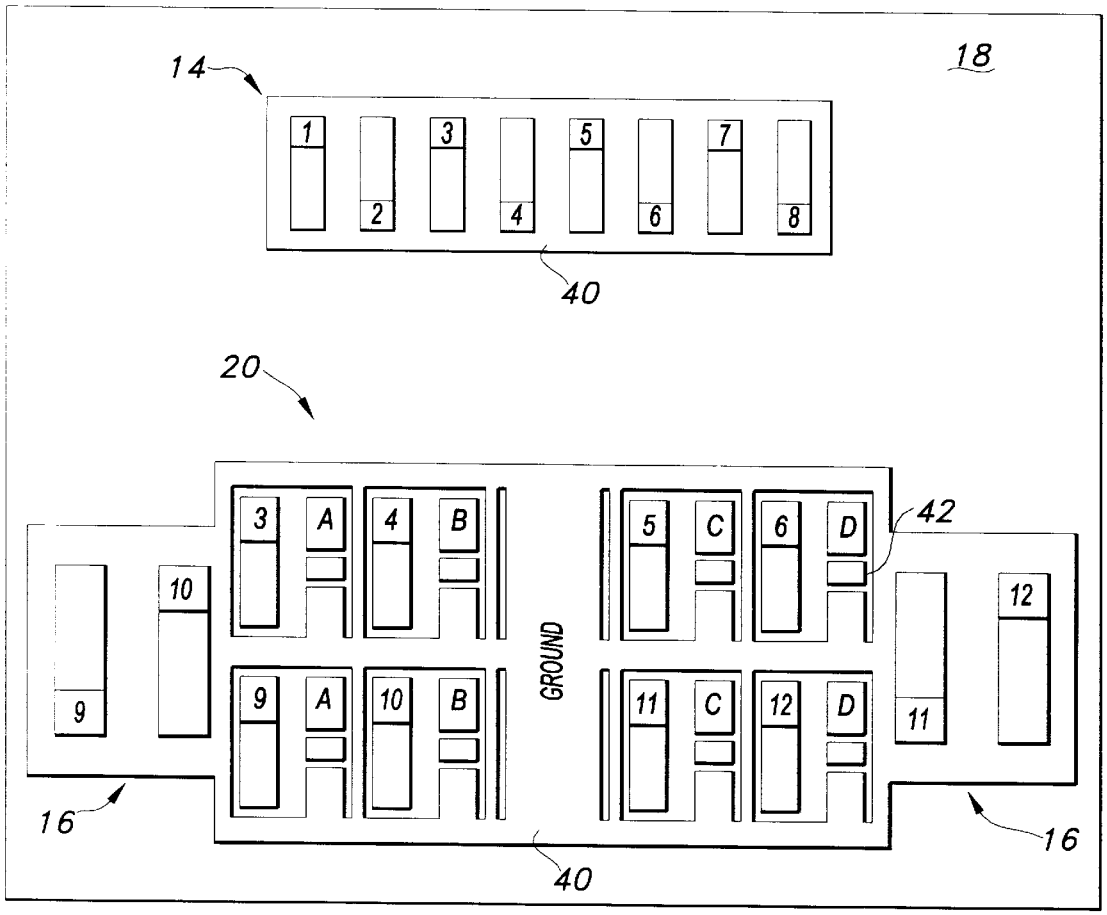
FIG. 7 is a plan view of the PCB of the present invention showing an alternate embodiment with a grounding pad fully extending between twisted pair contact pads, row contacts, and bifurcated contacts.

Shown in FIG. 7 is an alternate embodiment of the present contact grid 20 with grounding pad 40 positioned between the individual contacts 3–12 such that RF signals emanating therefrom will be pulled to electrical ground and not create crosstalk. In addition, the grounding pad 40 extends between the bifurcated contacts 16 displaying numerals 9 and 10, and 11 and 12. Further shown is the use of the grounding pad 40 between row contacts 14 such that RF signals emanating therefrom will be pulled to electrical ground and not create crosstalk. Staggering of the positions or apertures where adjacent bifurcated contacts 16 and row contacts 14 extend through the PCB 32 also prevents crosstalk in the present embodiment by creating even further physical separation between the twisted pair wires connected to the adjacent row contacts 14 and bifurcated contacts 16, which are already phase shifted one-hundred and eighty degrees due to the twisted pair combination.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

What is claimed is:

1. A switch for a data connector jack adaptable to receive a plug operating in a high frequency range or a plug operating in a low frequency range therein, the data connector jack being coupled to a cable having a plurality of wires contained therein, the switch having a primary state, an intermediate state, and a secondary state, the switch comprising:

a printed circuit board having a surface;

a plurality of row contacts mounted on the surface of the printed circuit board;

a plurality of bifurcated contacts spaced apart from the plurality of row contacts and mounted on the surface the printed circuit board; a grounding pad mounted on the surface of the printed circuit board; and a jumper assembly including:

an insulator pad; and a plurality of jumper springs flexibly connected to the insulator pad and in abutting contact with the surface of the printed circuit board such that at least one of the plurality of jumper springs is in abutting communication with the grounding pad when the plurality of jumper springs are in the open position, the transition position, and the closed position to prevent crosstalk among the plurality of jumper springs.

2. The switch for the data connector jack of claim 1 wherein when the switch is in the primary state the plurality of row contacts are electrically active for communicating with the plug operating in the high frequency range.

3. The switch for the data connector jack of claim 1 wherein when the switch is in the intermediate state at least one of the plurality of row contacts are electrically active and none of the plurality of bifurcated contacts are electrically active to prevent crosstalk between the plurality of bifurcated contacts during transition from the primary state to the secondary state of the switch.

4. The switch for the data connector jack of claim 1 wherein when the switch is in the secondary state the plurality of row contacts are electrically active for communicating with the plug operating in the low frequency range.

5. The switch for the data connector jack of claim 1 wherein the grounding pad individually surrounds each of the plurality of bifurcated contacts on the surface of the printed circuit board such that RF signals from any one of the plurality of bifurcated contacts is electrically grounded and is thereby prevented from interfering with another of the plurality of bifurcated contacts.

6. The switch for the data connector jack of claim 7 wherein the grounding pad individually surrounds each of the plurality of row contacts on the surface of the printed circuit board such that RF signals from any one of the plurality of row contacts is electrically grounded and is thereby prevented from interfering with another of the plurality of row contacts.

7. The switch for the data connector jack of claim 1 further comprising a plurality of contact pads each coupled through the printed circuit board to one of the plurality of row contacts.

8. The switch for the data connector jack of claim 7 wherein when the plurality of jumper springs transition from the open state to the closed state the plurality of jumper springs are in slidingly abutting communication with the plurality of contact pads such that debris is cleared from the plurality of contact pads.

9. The switch for the data connector jack of claim 7 wherein the grounding pad individually surrounds each of the plurality of contact pads on the surface of the printed circuit board such that RF signals from any one of the plurality of contact pads is electrically grounded and is thereby prevented from interfering with another of the plurality of contact pads.

10. A switch for a data connector jack adaptable to receive a plug operating in a high frequency range or a plug operating in a low frequency range therein, the data connector jack being coupled to a cable having a plurality of wires contained therein, the switch having a primary state, an intermediate state, and a secondary state, the switch comprising:

a printed circuit board having a surface;

a plurality of row contacts mounted on the surface of the printed circuit board;

a plurality of bifurcated contacts spaced apart from the plurality of row contacts and mounted on the surface the printed circuit board;

a jumper assembly including:

an insulator pad; and a plurality of jumper springs flexibly connected to the insulator pad and in abutting contact with the surface of the printed circuit board; and wherein when the switch is in the primary state the plurality of row contacts are electrically active for communicating with the plug operating in the high frequency range via the plurality of jumper springs being in the open position, and when the switch is in the secondary state the plurality of row contacts are electrically active for communicating with the plug operating in the low frequency range via the plurality of jumper springs being in the closed position.

11. The switch for the data connector jack of claim 10 when the switch is in the intermediate state at least one of the plurality of row contacts are electrically active and none of the plurality of bifurcated contacts are electrically active via the plurality of jumper springs being in the transition position.

12. The switch for the data connector jack of claim 10 further comprising a grounding pad mounted on the surface of the printed circuit board.

13. The switch for the data connector jack of claim 12 wherein at least one of the plurality of jumper springs is in abutting communication with the grounding pad when the plurality of jumper springs are in the open position, the transition position, and the closed position to prevent crosstalk among the plurality of jumper springs.

14. The switch for the data connector jack of claim 12 further comprising a plurality of contact pads each coupled through the printed circuit board to one of the plurality of row contacts.

15. The switch for the data connector jack of claim 12 wherein when the plurality of jumper springs transition from the open state to the closed state the plurality of jumper springs are in slidingly abutting communication with the plurality of contact pads such that debris is cleared from the plurality of contact pads.

16. The switch for the data connector jack of claim 12 wherein the grounding pad individually surrounds each of the plurality of contact pads on the surface of the printed circuit board such that RF signals from any one of the plurality of contact pads is electrically grounded and is thereby prevented from interfering with another of the plurality of contact pads.

17. The switch for the data connector jack of claim 12 wherein the grounding pad individually surrounds each of the plurality of bifurcated contacts on the surface of the printed circuit board such that RF signals from any one of the plurality of bifurcated contacts is electrically grounded and is thereby prevented from interfering with another of the plurality of bifurcated contacts.

18. The switch for the data connector jack of claim 12 wherein the grounding pad individually surrounds each of the plurality of row contacts on the surface of the printed circuit board such that RF signals from any one of the plurality of row contacts is electrically grounded and is thereby prevented from interfering with another of the plurality of row contacts.

19. A switch for a data connector jack adaptable to receive a plug operating in a high frequency range or a plug operating in a low frequency range therein, the data connector jack being coupled to a cable having a plurality of wires contained therein, the switch having a primary state, an intermediate state, and a secondary state, the switch comprising:

a printed circuit board having a surface;

a plurality of row contacts mounted on the surface of the printed circuit board;

a plurality of bifurcated contacts spaced apart from the plurality of row contacts and mounted on the surface the printed circuit board;

a jumper assembly including:

an insulator pad; and a plurality of jumper springs flexibly connected to the insulator pad and in abutting contact with the surface of the printed circuit board, the plurality of jumper springs having an open position, a transition position, and a closed position; and wherein when the switch is in the primary state the plurality of row contacts are electrically active for communicating with the plug operating in the high frequency range via the plurality of jumper springs being in the open position, when the switch is in the intermediate state at least one of the plurality of row contacts are electrically active and none of the plurality of bifurcated contacts are electrically active via the plurality of jumper springs being in the transition position, and when the switch is in the secondary state the plurality of row contacts are electrically active for communicating with the plug operating in the low frequency range via the plurality of jumper springs being in the closed position.

20. The switch for the data connector jack of claim 19 further comprising a grounding pad mounted on the surface of the printed circuit board such that at least one of the plurality of jumper springs is in abutting communication with the grounding pad when the plurality of jumper springs are in the open position, the transition position, and the closed position to prevent crosstalk among the plurality of jumper springs.

21. The switch for the data connector jack of claim 20 further comprising a plurality of contact pads each coupled through the printed circuit board to one of the plurality of row contacts.

22. The switch for the data connector jack of claim 20 wherein when the plurality of jumper springs transition from the open state to the closed state the plurality of jumper springs are in slidingly abutting communication with the plurality of contact pads such that debris is cleared from the plurality of contact pads.

23. The switch for the data connector jack of claim 20 wherein the grounding pad individually surrounds each of the plurality of contact pads on the surface of the printed circuit board such that RF signals from any one of the plurality of contact pads is electrically grounded and is thereby prevented from interfering with another of the plurality of contact pads.

24. The switch for the data connector jack of claim 20 wherein the grounding pad individually surrounds each of the plurality of bifurcated contacts on the surface of the printed circuit board such that RF signals from any one of the plurality of bifurcated contacts is electrically grounded and is thereby prevented from interfering with another of the plurality of bifurcated contacts.

25. The switch for the data connector jack of claim 20 wherein the grounding pad individually surrounds each of the plurality of row contacts on the surface of the printed circuit board such that RF signals from any one of the plurality of row contacts is electrically grounded and is thereby prevented from interfering with another of the plurality of row contacts.

* * * * *